US007870831B2

(12) United States Patent
Richert et al.

(10) Patent No.: US 7,870,831 B2
(45) Date of Patent: Jan. 18, 2011

(54) ANCHOR WITH SNAG RELEASE MECHANISM

(76) Inventors: David Richert, 11579 54th St. N., West Palm Beach, FL (US) 33411; Scott McCord, 17756 30th La. North, Loxahatchee, FL (US) 33470; Joseph Richert, 11547 54th St. N., West Palm Beach, FL (US) 33411

( * ) Notice: Subject to any disclaimer, the term of this patent is extended or adjusted under 35 U.S.C. 154(b) by 104 days.

(21) Appl. No.: 12/418,160

(22) Filed: Apr. 3, 2009

(65) Prior Publication Data

US 2009/0314196 A1 Dec. 24, 2009

Related U.S. Application Data

(60) Provisional application No. 61/074,720, filed on Jun. 23, 2008.

(51) Int. Cl.

| | |
|---|---|
| ***B63B 21/24*** | (2006.01) |
| ***B63B 21/26*** | (2006.01) |
| ***B63B 21/30*** | (2006.01) |
| ***B63B 21/38*** | (2006.01) |
| ***B63B 21/46*** | (2006.01) |

(52) U.S. Cl. ..... 114/294; 114/297; 114/299; 114/301

(58) Field of Classification Search ..... 114/293–295, 114/297–310, 210

See application file for complete search history.

(56) References Cited

U.S. PATENT DOCUMENTS

| | | | |
|---|---|---|---|
| 594,769 | A | 11/1897 | Ward |
| 1,899,866 | A | 2/1933 | Harvey |
| 2,007,667 | A | 4/1933 | Stubbs |
| 2,413,596 | A | 12/1946 | Wood, Jr. |
| 2,568,006 | A | 9/1951 | Illsche |
| 2,606,518 | A | 8/1952 | Christie |
| 2,764,116 | A | 9/1956 | Brewer |
| 2,797,658 | A | 7/1957 | Doty, Jr. |
| 2,816,522 | A | 12/1957 | Root |
| 3,030,907 | A | 4/1962 | Rosselle |
| 3,150,629 | A | 9/1964 | Fields |
| 3,249,082 | A | 5/1966 | Noel et al. |

(Continued)

FOREIGN PATENT DOCUMENTS

JP 01190597 A * 7/1989

*Primary Examiner*—Ajay Vasudeva
(74) *Attorney, Agent, or Firm*—Gold & Rizvi, P.A.; H. John Rizvi; Glenn E. Gold

(57) ABSTRACT

An anchor incorporates a release mechanism that is releasably assembled to a shank. An anchor chain is affixed to a crown section of the anchor. The chain is slideably inserted through a tubular release mechanism body. A tension controlling mechanism is elastically coupled between the release mechanism and the anchor chain. A pair of release interface notches is formed within the proximal end of the release mechanism; the slots are placed on opposing sides of the release mechanism. A pair of release interface fasteners is disposed along a distal end of the shank. The release mechanism is held in a mooring configuration by engaging the release interface notches and the release interface fasteners. The release mechanism maintains the chain in a mooring configuration until the release mechanism is rotated perpendicular to the shank, wherein the release interface notches disengage from the release interface fasteners changing a tensile force from an anchor engaging direction to a releasing direction.

20 Claims, 20 Drawing Sheets

U.S. PATENT DOCUMENTS 3,762,357 A * 10/1973 Ehrhardt ..... 114/298
3,841,255 A 10/1974 Mansfield
3,913,514 A 10/1975 Reynolds
3,995,577 A 12/1976 Gentry
4,019,455 A 4/1977 Hungerford
4,098,217 A 7/1978 Altman
4,114,554 A 9/1978 Miller
4,134,355 A 1/1979 Carruthers
4,369,727 A 1/1983 Fasco
4,417,538 A 11/1983 El-Ramney
4,721,054 A 1/1988 Kobayashi
4,836,126 A 6/1989 Kobayashi
4,846,093 A 7/1989 Norena
4,848,261 A 7/1989 Kobayashi
4,951,593 A 8/1990 Brown et al.
5,074,235 A 12/1991 Kobayashi
5,666,899 A 9/1997 Andersen
6,009,826 A 1/2000 Nole
6,951,183 B1 10/2005 Burback
7,121,224 B2 10/2006 Saarelainen

* cited by examiner

ANCHOR WITH SNAG RELEASE MECHANISM

CROSS-REFERENCE TO RELATED APPLICATION

This Non-Provisional Utility application claims the benefit of co-pending U.S. Provisional Patent Application Ser. No. 61/074,720, filed on Jun. 23, 2008, which is incorporated herein in its entirety.

BACKGROUND OF THE INVENTION

1. Field of the Invention

This invention relates generally to boat and ship anchors, and more particularly to an anchor having a release mechanism facilitating disengagement of the anchor from an underwater snag.

2. Description of the Prior Art

An anchor line is normally attached to a free, distal end of an elongated shank of an anchor. The line is used to raise and lower an anchor from a boat under normal operating conditions. However, should the flukes of the anchor become fouled or snagged by a bottom obstruction; continued pulling of the anchor line from the boat will many times result in increasing the hold which the anchor has on the obstruction. In such cases, the anchor is generally abandoned, such as by cutting the anchor line.

It has become well known that anchors fouled on a bottom obstruction. There are several teachings demonstrating how the anchor can be released by temporarily transferring the lifting force on the anchor line from the distal end of the shank to the crown of the anchor. This change in tensile orientation causes the flukes to be withdrawn from the engaging obstruction.

One such means utilizes a releasing mechanism in the form of an "S-shaped" clip, which pivots about a pin through the distal end of the shank. The open end of the clip secures the chain to the distal end of the shank until the line is pulled horizontally perpendicular to the shank, thus releasing the chain from the clip. Once released, the chain orientation rotates from a tensile force substantially engaging the flukes to one that is substantially disengaging of the flukes. Thereafter, once the release mechanism is overcome and separated from the shank, the anchor line will apply a generally vertical force to the crown of the anchor to affect anchor dislodgment. The clip release mechanism is limited, requiring the anchor line to be pulled in an orientation that can be difficult to obtain, thus providing an ineffective releasing configuration.

Another such means utilizes a releasing mechanism having a pair of "C" shaped, engaging links (often referred to as a slip link), which become disengaged from each other upon a predetermined strain. This embodiment is limited in that the normal tension of an anchor line could be sufficient to disengage the releasing mechanism.

Therefore, a reliable and repeatable releasing mechanism being easily operated, avoiding unwarranted disengagements, and having a low fabrication cost is desired.

SUMMARY OF THE INVENTION

This invention is directed to a boat anchor and a retrieving mechanism for clearing the anchor from being engaged with an underwater obstruction. The anchor includes an anchor body (such as a fluke, a plough head, a grappling configuration, and the like) and a shank pivotally connected to the anchor body. The anchor chain is slidably located through a hollow center section of a tubular releasing mechanism. The tubular releasing mechanism includes a pair of release interface notches disposed on opposing sides along the mechanism's proximal edge. The release interface notches engage with a pair of respective release fasteners. The release fasteners maintain the release mechanism in communication with the shank until purposely released. When the release mechanism is disengaged, upward anchor line lifting force shifts from engaging the flukes to a force being applied directly to the crown, releasing the flukes from an object.

In one general aspect of the present invention:

an anchor having an anchoring head, a shank having a pivotal relation to the anchor head and a pair of release fasteners disposed proximate a distal end of the shank, an anchor chain attached proximate a crown section of the anchor head, a tubular release mechanism, wherein the anchor chain slidably passes through the center portion of the tubular release mechanism, a pair of release notches located on each opposing side of a proximal end of the tubular release mechanism utilizes a tubular release mechanism in slidable communication with an anchor chain, and a tension controlling mechanism elastically coupled between the tubular release mechanism and at least one of the anchor chain and the shank.

Another aspect of the present invention provides an elastic band anchored to opposing sides of the tubular release mechanism and positioned through at least one link of the anchor chain.

While another aspect provides at least one of a triangular shaped release notch, a dovetail shaped release notch and a rectangular shaped release notch.

Yet another aspect provides a shank having two parallel members.

In a further aspect of the present invention, the shank is formed having a "U" shaped cross sectional shape.

In still a further aspect of the present invention, the release interface fasteners are adjustably positioned along the length of the shank.

While another aspect utilizes any anchor head design, including a grappling head, a plough, and the like.

In yet another aspect provides at least one of a rotational and a pivotal communication between the shank and the anchor head.

With another aspect providing a locking interface for use during storage or severe weather and/or wave conditions. The release override, locking mechanism utilizes the same release mechanism interface pin engaging with a storm securing slot in conjunction with a release override bolt inserted through a separate release override bolt fastening aperture.

Yet another aspect stores the release override bolt within the crown portion of the anchor.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF REPRESENTATIVE EMBODIMENTS

Shown throughout the Figures, the invention is directed to an anchor incorporating a tubular release mechanism, presenting various deviations of the generic invention.

A first exemplary embodiment of the present invention is referred to as a releasing anchor 100 is presented in FIGS. 1 through 8. The figures present the present invention, including the operative steps of the releasing mechanism.

Figure 20:
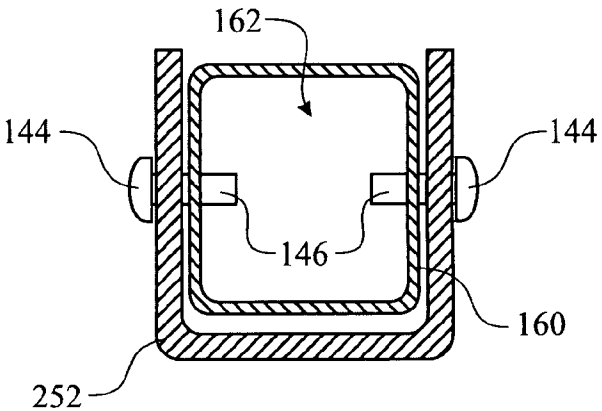
FIG. 20 is a sectional top view of the release mechanism engaged with an alternate "C" channel styled shank.
Figure 21:
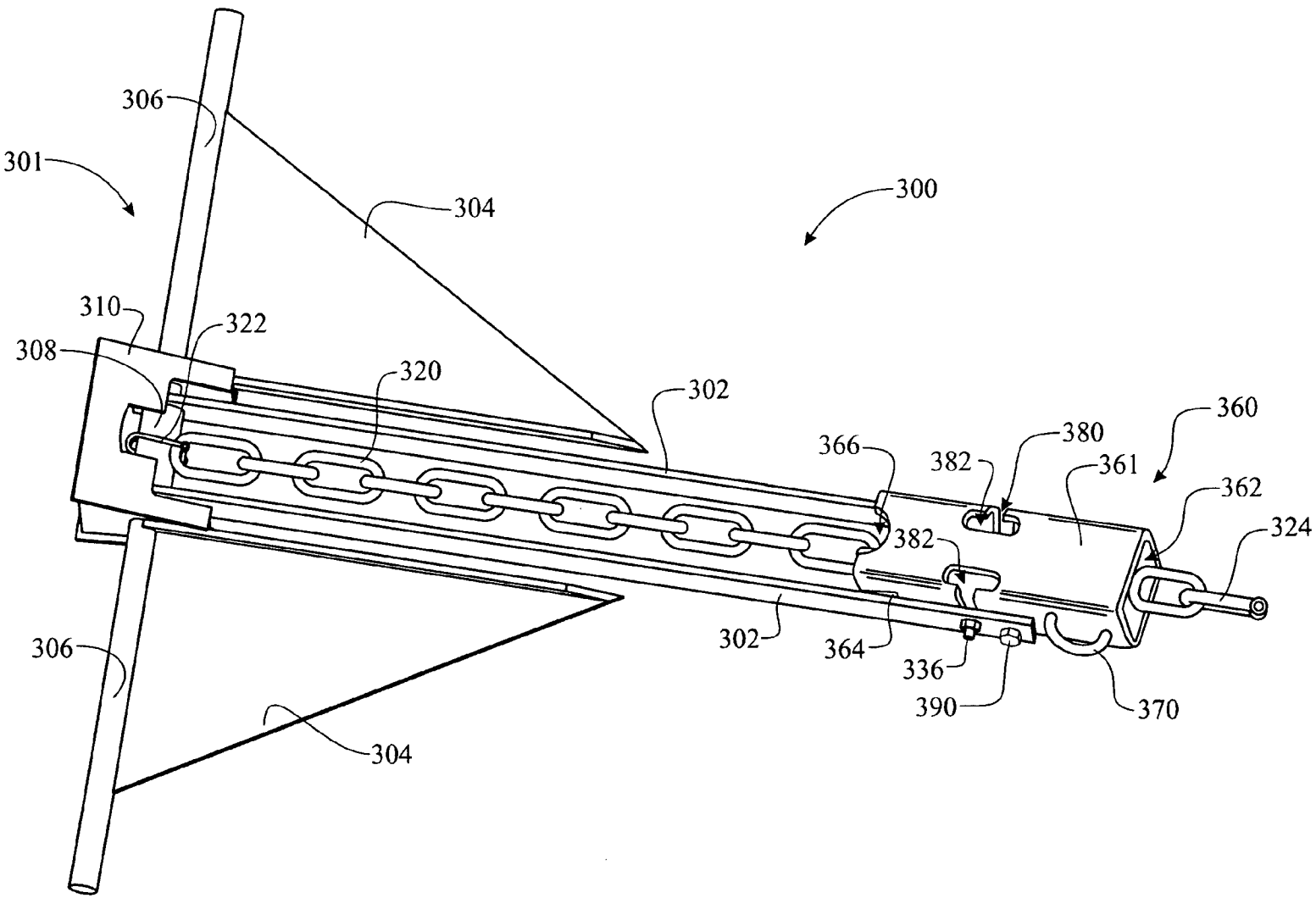
FIG. 21 is an isometric, side view of a fluke style anchor incorporating the inventive release mechanism further comprising a storm and storage locking feature.
Figure 22:
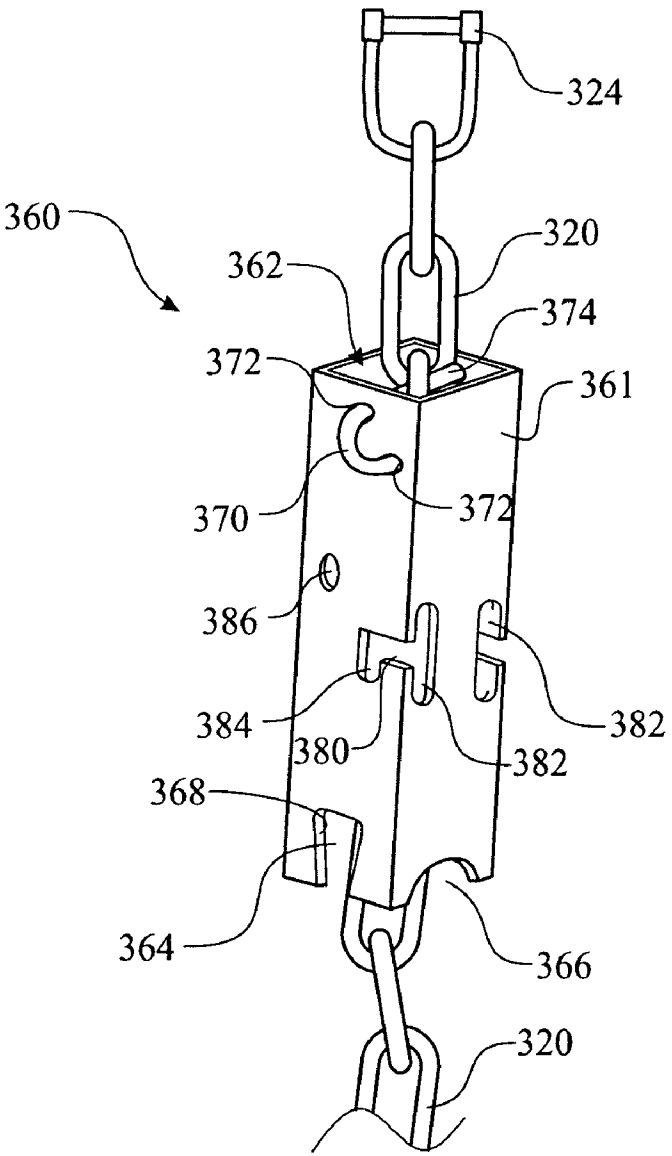
FIG. 22 is a magnified view of the releasing mechanism of FIG. 21.

The releasing anchor 100 consists of the primary components of an anchor, incorporating a releasing mechanism 130. The anchor comprises an anchor head 101; the exemplary anchor head 101 being a fluke anchor form factor having a pair of flukes 104 projecting from a stock 106. The stock 106 is assembled to a crown 110. A stock chain section 108 is disposed upon a center section of the crown 110 providing a pivotal coupling to a shank 102. The shank 102 can be of any desired form factor; being illustrated as two independent members herein. The shank 102 can alternately be a "U" shaped form factor as shown in FIG. 20. The anchor secures a hold along the bottom of the body of water by the pivoting action of the flukes 104 respective to the shank 102. It is recognized the pivotal relationship can be provided at any reasonable portion of the anchor.

A chain 120 is pivotally secured to the stock chain section 108 via an anchor shackle 122. A line shackle 124 is attached at an opposing end of the chain 120 for securing an anchor line (not shown). Although illustrated as a linked chain, the chain 120 can alternately be a cable, a rope, and the like, incorporating a connecting feature for attaching an elastic member 134. The anchor line can be chain, cable, rope, and the like. The shackles 122, 124 can be of any desired form factor for accomplishing the removable connection. A releasing mechanism 130 is assembled to the releasing anchor 100 via inserting the chain 120 through a release body central passage 132 of a release member tubular body 131 of the releasing mechanism 130. A pair of release interface notches 140 is disposed along opposing sides of a proximal edge of the release member tubular body 131. The release interface notches 140 initiate along a proximal edge of the release member tubular body 131, and continue longitudinally. The longitudinal walls or notch side walls 148 of the release interface notch 140 can be angled as illustrated, to aid in the re-installation of the release member tubular body 131 into a mooring configuration. In the exemplary embodiment, the two non-parallel notch side walls 148 of each release interface notch 140 are oriented converge towards each other as the side walls extend away from a releasing end of said release mechanism 130. The release interface notch 140 releasably engages with a releasing interface fastener 136 securing the release member tubular body 131 at a distal end of the shank 102. This maintains the chain 120 generally parallel with the shank 102 while moored. The release member tubular body 131 is held in a relational position engaging the release interface notch 140 with the releasing interface fastener 136 via the elastic member 134. The elastic member 134 is fabricated of any elastic material, such as rubber, a spring, and the like. The elastic member 134 is fastened to the release member tubular body 131 in any reasonable manner, such as via an elastic member cleat 135 located on opposing sides of the release member tubular body 131 as illustrated. The elastic member 134 is threaded through one of the links of the chain 120. The elastic member 134 applies tension between the releasing mechanism 130 and the chain 120, ensuring the release member tubular body 131 remains engaged. The shank 102 can include a series of fastener mounting apertures 138 for insertion of the releasing interface fastener 136, thus providing an adjustable configuration for the location and respective tension of the releasing mechanism 130. A shank end termination member 112 can be disposed upon the distal end of the shank 102 if desired.

Figure 1:
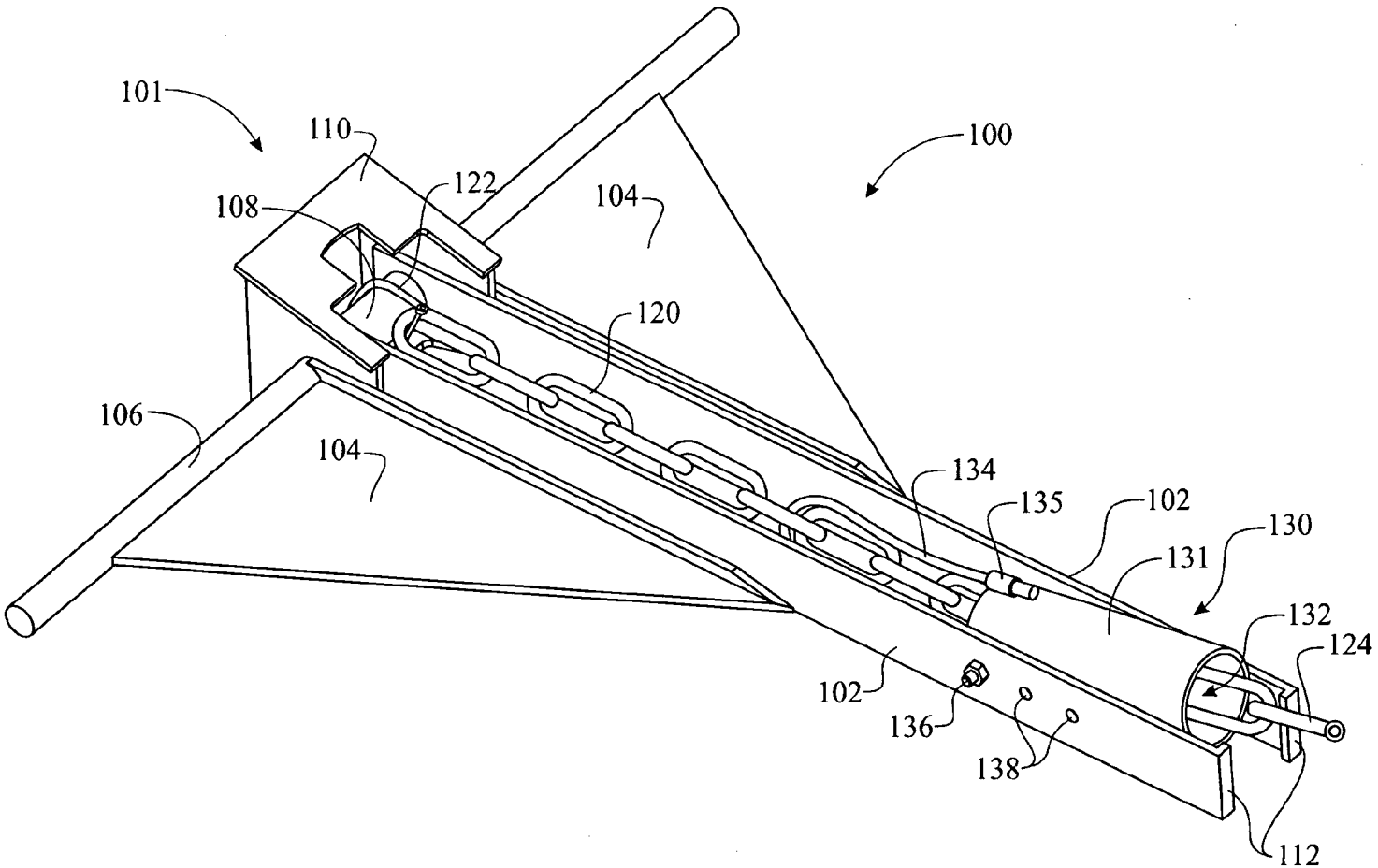
FIG. 1 is an isometric, side view of a fluke style anchor incorporating the inventive release mechanism.
Figure 2:
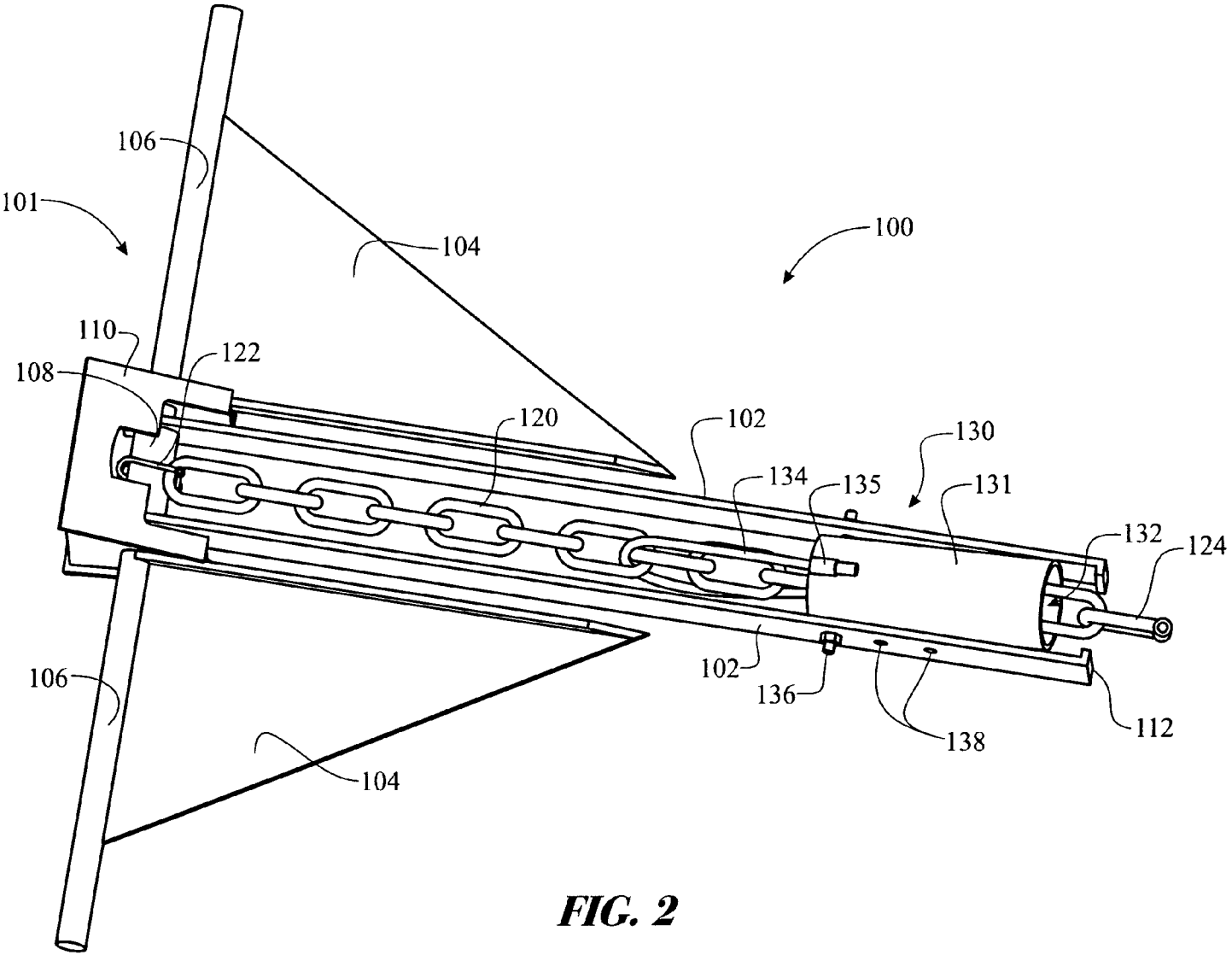
FIG. 2 is isometric, top view of the fluke style anchor incorporating the inventive release mechanism of FIG. 1.
Figure 3:
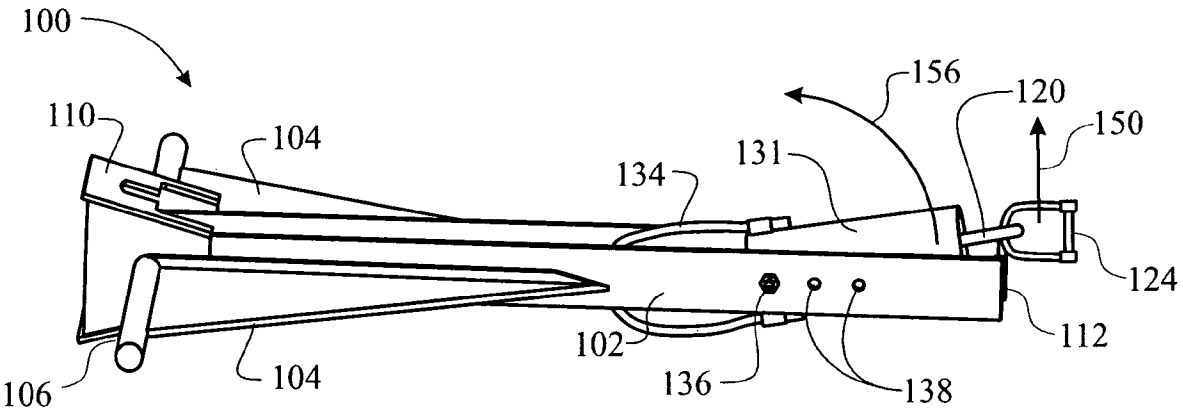
FIG. 3 is a side elevation view of the fluke style anchor presenting a first motion of the releasing process.
Figure 4:
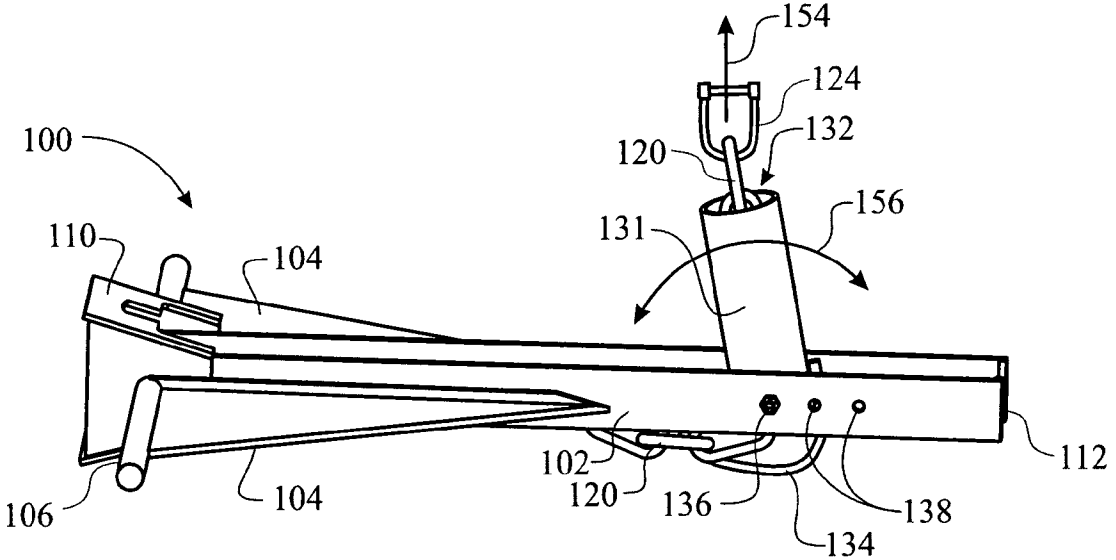
FIG. 4 is a side elevation view of the fluke style anchor presenting a second motion of the releasing process.
Figure 5:
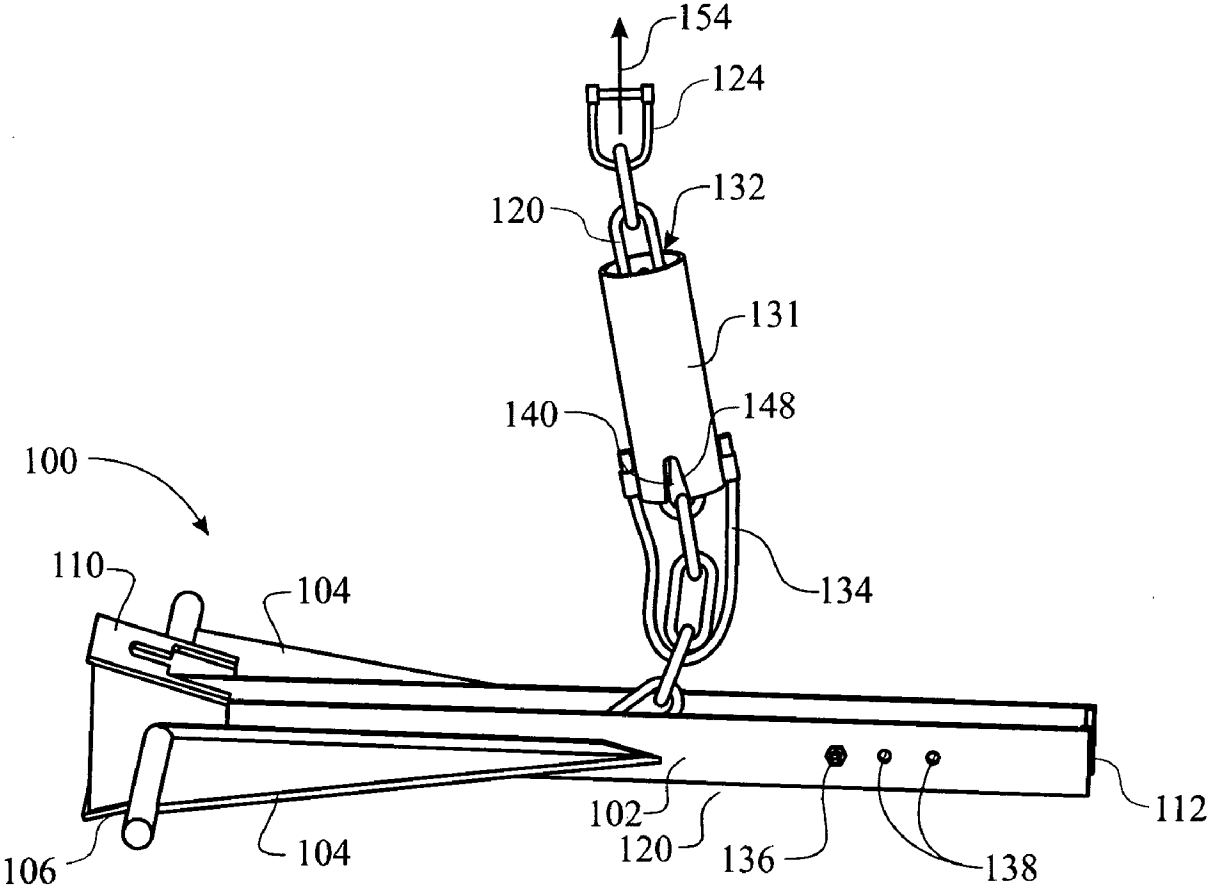
FIG. 5 is a side elevation view of the fluke style anchor presenting a third motion of the releasing process.
Figure 7:
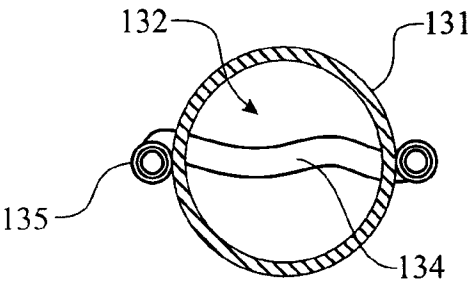
FIG. 7 is a sectioned top view of the exemplary embodiment of the release mechanism taken along section 7-7 of FIG. 6.
Figure 6:
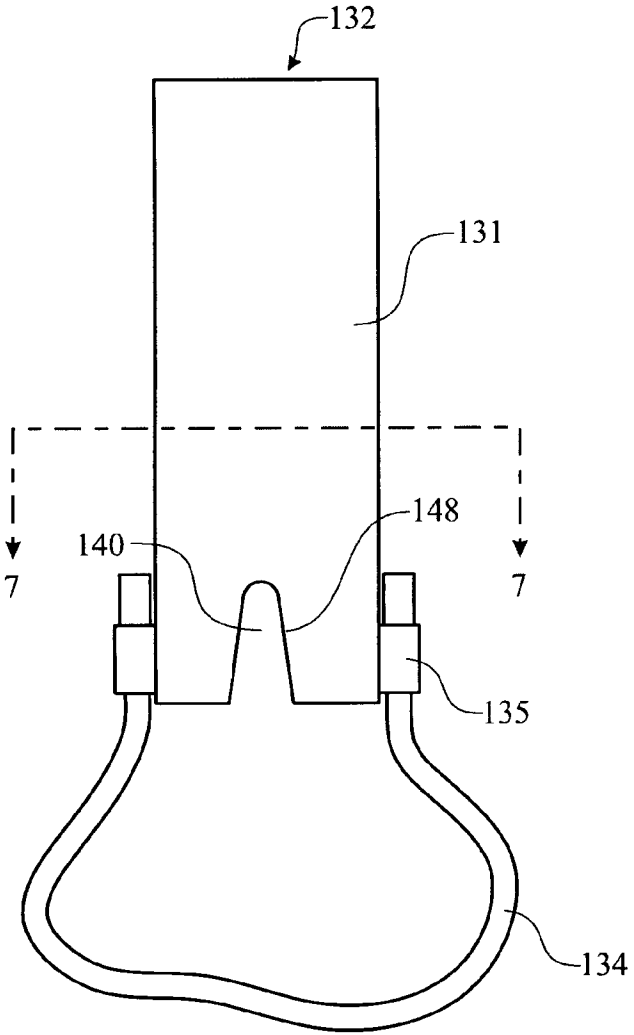
FIG. 6 is an elevation view of an exemplary embodiment of the release mechanism.
Figure 8:
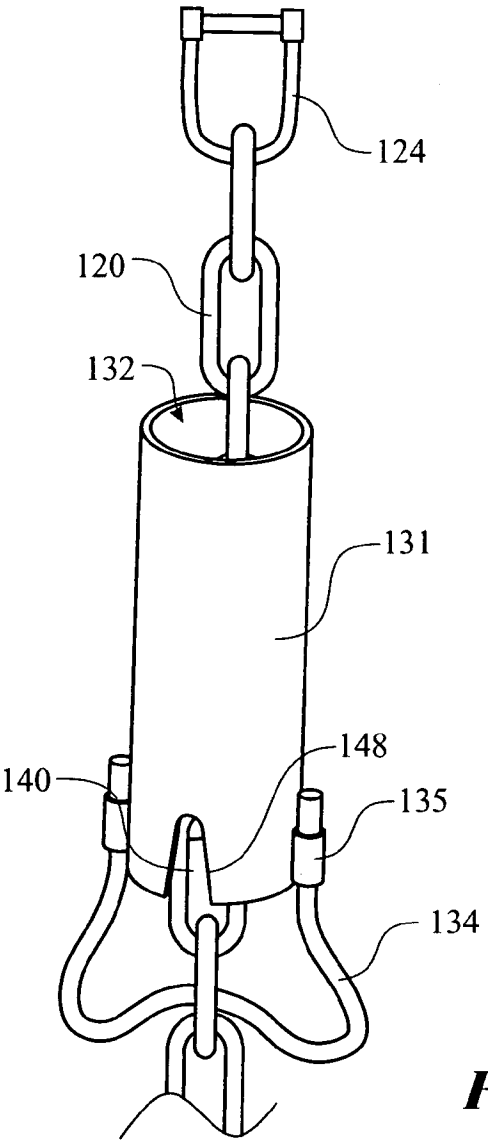
FIG. 8 is an isometric top view of the release mechanism as installed over the anchor chain.

The operation of the releasing mechanism 130 is best represented in FIGS. 3 through 5. The chain 120 is located through the release body central passage 132 of the release member tubular body 131, whereby the release member tubular body 131 provides a guide for a direction of tension applied to the anchor 100 via the chain 120. While the release member tubular body 131 is secured to the distal end of the shank 102, the anchor 100 is subjected to a mooring force. Once the release member tubular body 131 is released from the shank 102, the anchor 100 is subjected to a releasing force. An initial anchor releasing force 150 is applied to the line shackle 124 causing a rotational motion 156 of the release member tubular body 131. Once rotated into an orientation that is substantially perpendicular to the shank 102, the release interface notch 140 disengages from the releasing interface fastener 136. Prior to the perpendicular (releasing) orientation, the elastic member 134 maintains the engagement between the release interface notch 140 and the releasing interface fastener 136. Since the release member tubular body 131 is slidably assembled to the chain 120, the tension of the chain 120 does not impact the engagement between the release interface notch 140 and the releasing interface fastener 136. An advantage to releasing the anchor 100 via a releasing motion is directed towards the environment. The releasing motion helps ensure the anchor is not left on the bottom of the water body. Additionally, the releasing motion avoids damage to obstructions along the bottom of the water body, such as coral reefs, and the like.

Figure 11:
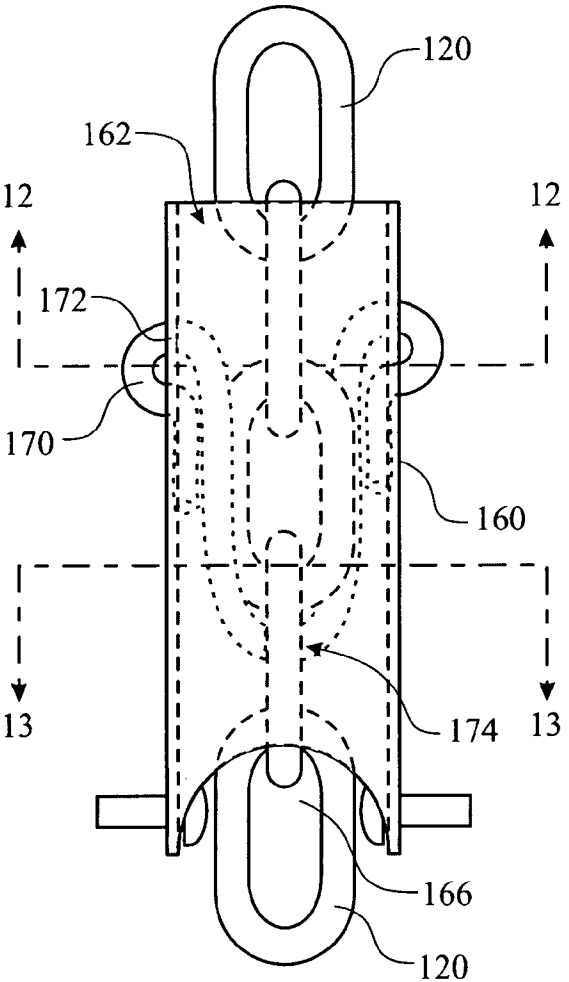
FIG. 11 is an elevation view of the releasing mechanism presented in FIG. 9 detailing the elastic retaining member.

An alternate releasing mechanism configuration is installed on a releasing anchor 100*a* and illustrated in FIGS. 9 through 13. The alternate releasing mechanism is fabricated having a rectangular releasing member body 160. A pair of release interface notch 164 is disposed along opposing sides of a proximal end of the rectangular releasing member body 160. A pair of chain clearance 166 is disposed on the proximal end of the rectangular releasing member body 160 along the two sides that are perpendicular to those comprising the release interface notch 164. The chain clearance 166 provides clearance for the chain 120, improving the rotational motion 156. Engaging tension is applied via an elastic retaining member 170. The elastic retaining member 170 is assembled to the rectangular releasing member body 160 via looping the elastic retaining member 170 through a pair of elastic member securing aperture 172 located on each of the opposing sides of the rectangular releasing member body 160 as best shown in FIG. 11. The elastic retaining member 170 is threaded through a chain clearance 166 of the chain 120, presented as an elastic-chain interface 174. The rectangular shape of the rectangular releasing member body 160 provides mechanical stability (reducing any potential torsional motion about a longitudinal axis) between the rectangular releasing member body 160 and the shank 102. An optional interface flange 142 can be utilized, wherein the release interface notch 164 engages with the releasing interface fastener 136 and the interface flange 142. The interface flange 142 resides against the inner wall of the rectangular releasing member body 160, maintaining each of the shank 102 proximate the respective sidewall of the rectangular releasing member body 160. An optional shank control line 126 can be assembled between a position proximate a distal end of the chain 120 and a distal end of the shank 102 providing the user with a aiding means for reattaching the shank 102 and the distal end of the chain 120.

Figure 14:
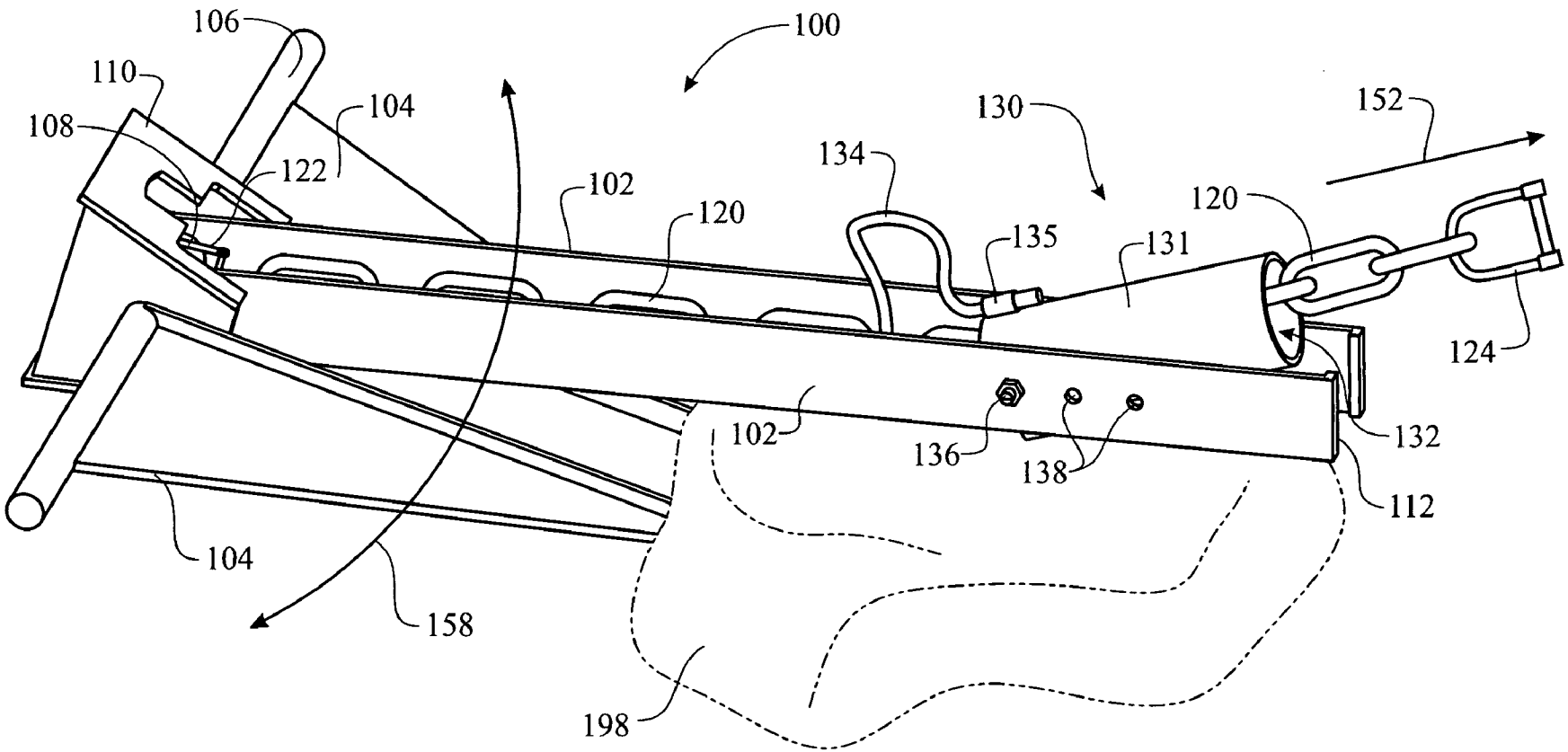
FIG. 14 is an isometric side view of the exemplary fluke anchor engaged with an obstructing object.
Figure 15:
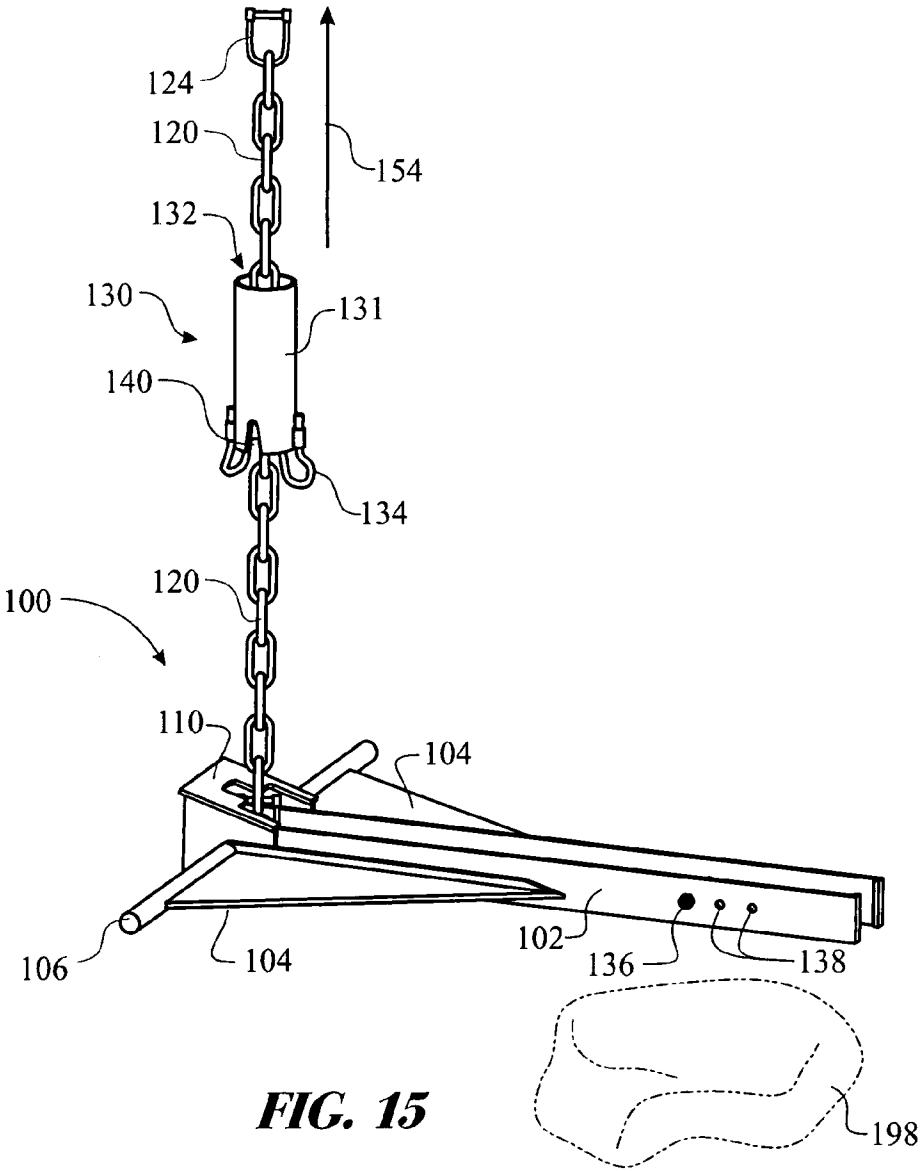
FIG. 15 is an isometric side view of the exemplary fluke anchor shown disengaging from an obstructing object.

Additional details of the releasing process are provided in FIGS. 14 and 15. The shank 102/flukes 104 of the releasing anchor 100 moves in accordance with a shank rotation 158 allowing the flukes 104 to engage with an object along the bottom of a body of water, such as an obstruction 198. When a mooring force 152 is applied, the flukes 104 continue to engage with the obstruction 198 mooring the vessel. The user then causes the releasing mechanism 130 to disengage from the shank 102 converting the mooring force 152 to an anchor lifting force 154. The anchor lifting force 154 changes the orientation of the tensile force from a mooring force 152 to one that releases the flukes 104 from the obstruction 198. Although the anchor lifting force 154 is shown being applied vertically, it is understood the force can be directed at an angle more towards the crown 110, ensuring the release of the anchor from the obstruction 198.

The application of the present invention is not limited to a fluke styled anchor. A grappling anchor 200 incorporating the releasing mechanism 130 is presented in FIGS. 16 though 18. The exemplary anchor head being a grappling anchor form factor having a plurality of grappling hooks 204 projecting from a central section. The plurality of grappling hooks 204 can be individual members assembled into a single assembly or formed as a single assembly. The grappling hooks 204 are rotationally and pivotally secured to a grappling shank 202 via an end fastener 206. A grappling end plate 208 can be disposed about the center section of the anchor head providing support to the structure. The chain 120 is secured to the proximal end of the grappling shank 202 via a junction formed by an anchor chain cleat 210. The releasing mechanism 130 is assembled to the grappling anchor 200 and functions as previously described herein.

Figure 19:
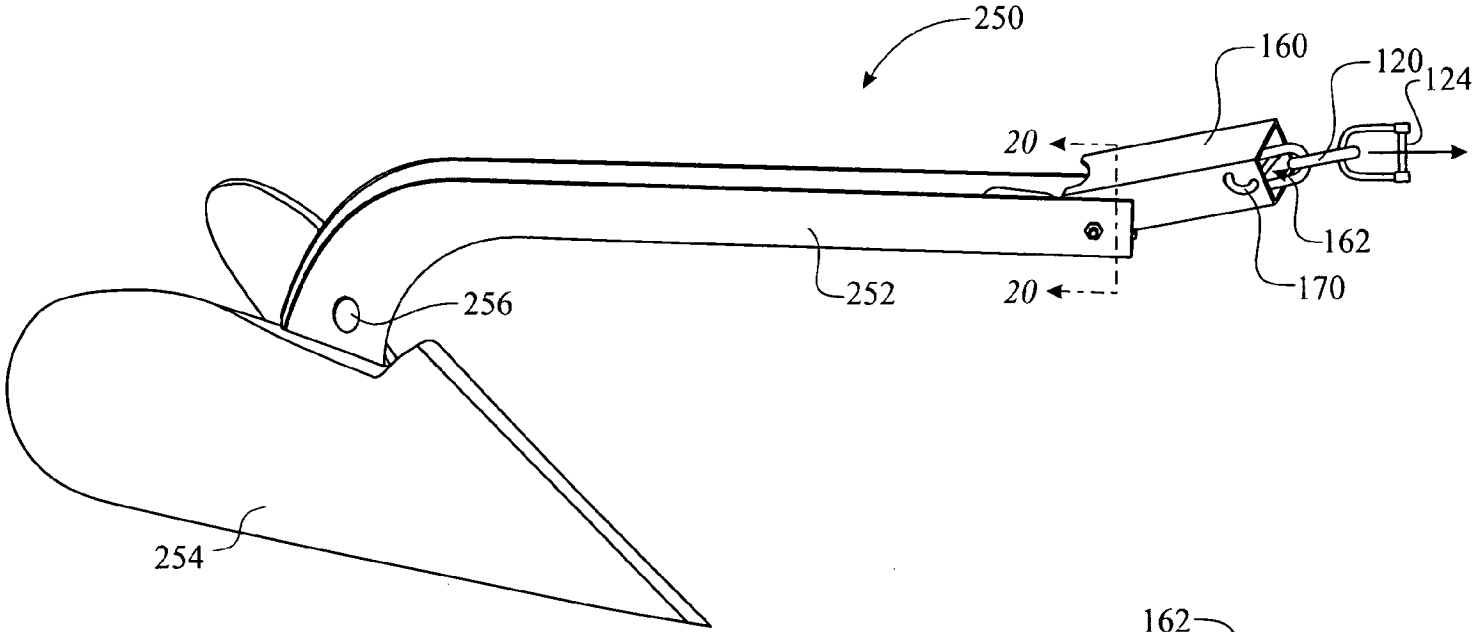
FIG. 19 is an isometric side view illustrating yet another exemplary anchor configuration incorporating a plough anchor head arrangement.

Another exemplary form factor for the anchor head is a plough design. A plough anchor 250 incorporating the alternate releasing mechanism is presented in FIG. 19 with a detailed cross section of a plough anchor shank 252 being presented in FIG. 20. The plough anchor 250 includes a plough head 254, which is pivotally coupled to the plough anchor shank 252. The plough head 254 is generally fabricated via a casting process, although other fabrication processes such as forging, and the like can be utilized. In the exemplary embodiment, the plough anchor shank 252 can be of a "U" shape as shown in the cross sectional illustration of FIG. 20. The rectangular releasing member body 160 is of a rectangular (more specifically a square) cross section geometry, limiting any torsional motion of the rectangular releasing member body 160 within the plough anchor shank 252. The plough anchor shank 252 is of a single continuous material, thus not requiring the holding design of the previously presented parallel beam embodiment. Release pins 146 (excluding the inclusion of an interface flange 142) can be utilized as the releasing interface fastener. The release pins 146 can be fastened via any number of means, including welding, threading (utilizing a release pin heads 144), and the like. The rectangular releasing member body 160 and the respective components are assembled to the plough anchor 250 and functions as previously described herein.

An enhanced release mechanism and its various configurations are presented in FIGS. 21 through 24, 26, and 27. A releasing anchor 300 comprises commonly known features of an exemplary anchor; more specifically illustrated as a fluke anchor. The releasing anchor 300 comprising an anchor head 301; the exemplary anchor head 301 being a fluke anchor form factor having a pair of flukes 304 projecting from a stock 306. The stock 306 is assembled to a crown 310. A stock chain section 308 is disposed upon a center section of the crown 310 providing a pivotal coupling to a shank 302. It is recognized the stock chain section 308 can be of any form factor. The shank 302 can be of any desired form factor; being illustrated as two independent parallel members herein. The shank 302 can alternately be a "U" shaped form factor as shown in FIG.

Figure 25:
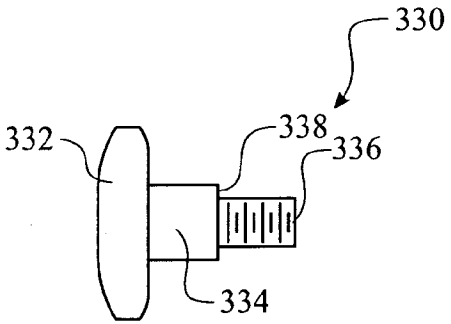
FIG. 25 is an elevation view of a shoulder bolt used as an interface to the release mechanism.
Figure 26:
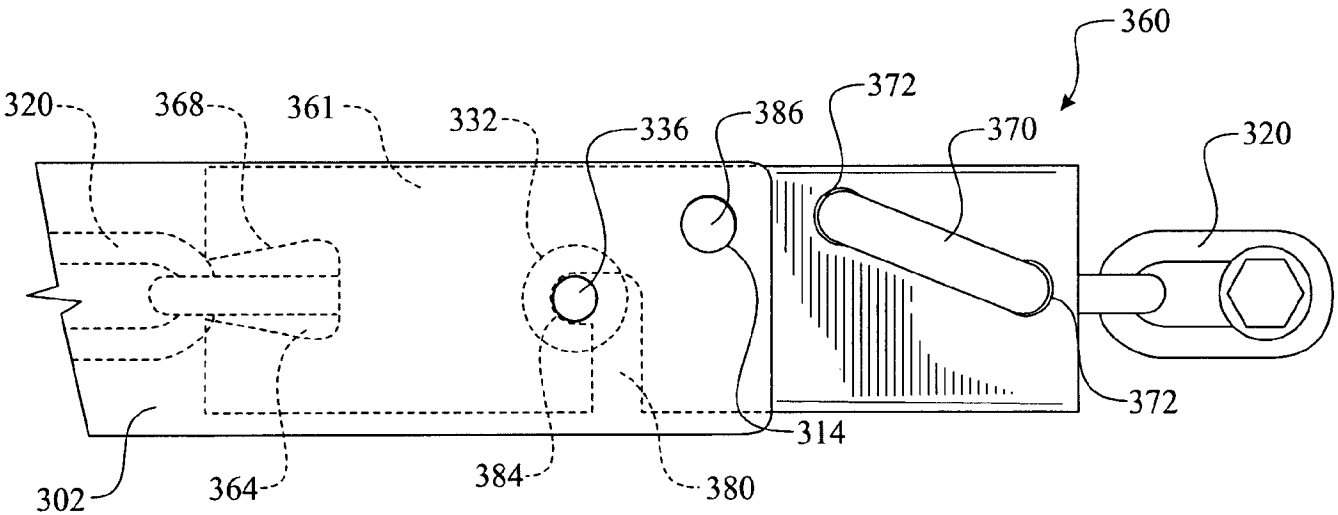
FIG. 26 is an elevation view of the release mechanism installed in a storage or storm ready configuration.

20. A shoulder bolt 330 (FIG. 25) is assembled to each of the shank 302 in a mirror image relation. The shoulder bolt 330 are assembled inserting a shoulder bolt threaded end 336 into a mating threaded aperture provided within the shank 302, oriented having a shoulder bolt head 332 placed between the pair of shank 302. The shoulder bolt 330 is inserted seating a shoulder 338 against an inner wall of the shank 302, leaving a shoulder bolt shaft 334 exposed between the inner wall of the shank 302 and the seating side of the shoulder bolt head 332.

Figure 9:
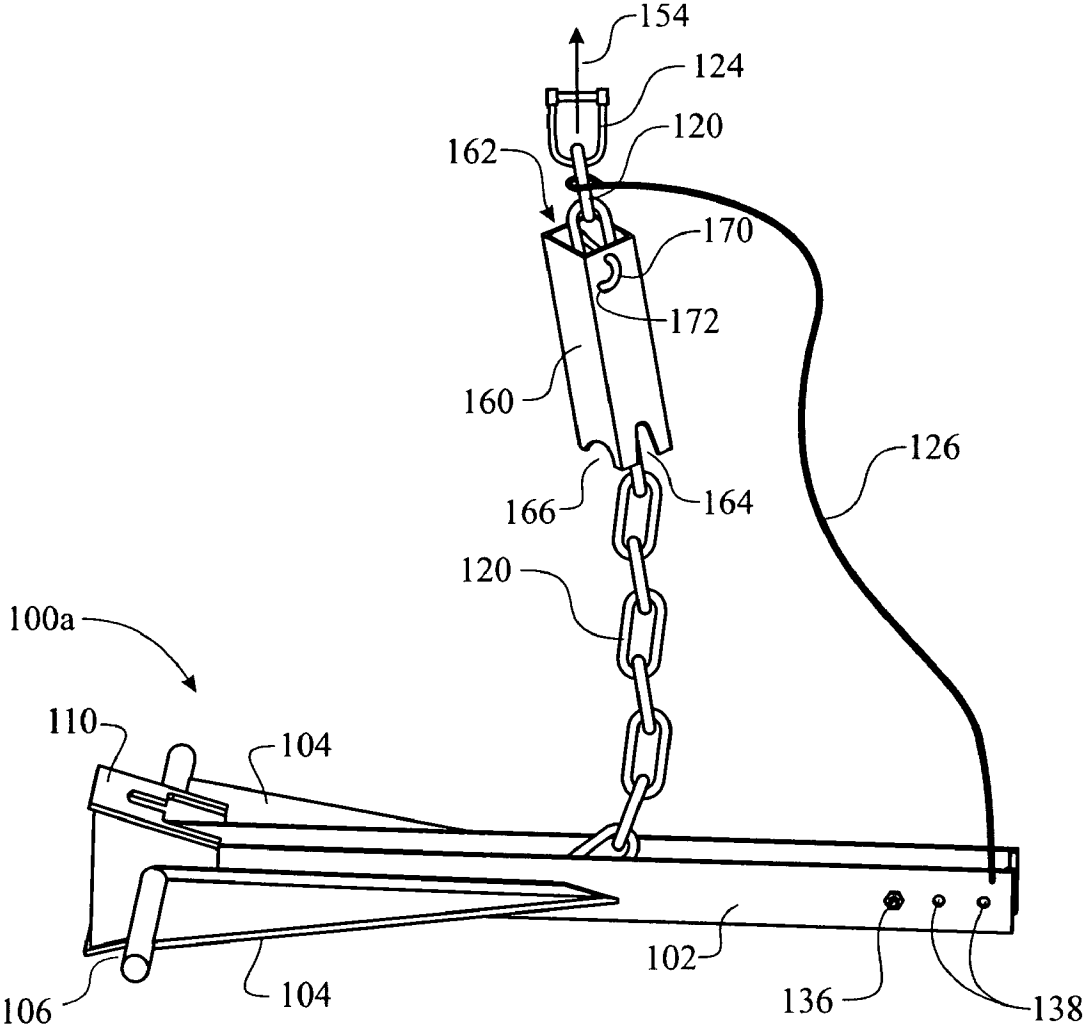
FIG. 9 is a side elevation view of the fluke style anchor having an alternately shaped releasing mechanism shown in the anchor-releasing configuration.
Figure 10:
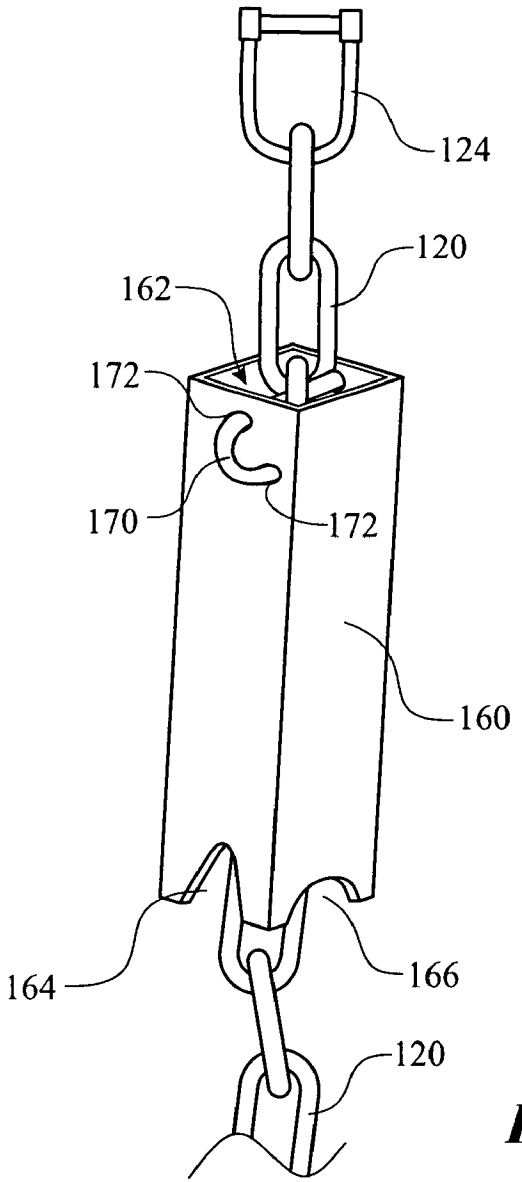
FIG. 10 is a magnified view of the releasing mechanism of FIG. 9.
Figure 12:
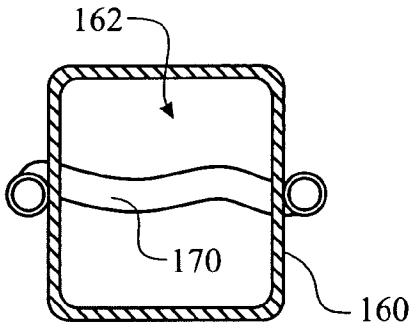
FIG. 12 is a sectioned bottom view of the exemplary embodiment of the release mechanism taken along section 12-12 of FIG. 11.
Figure 13:
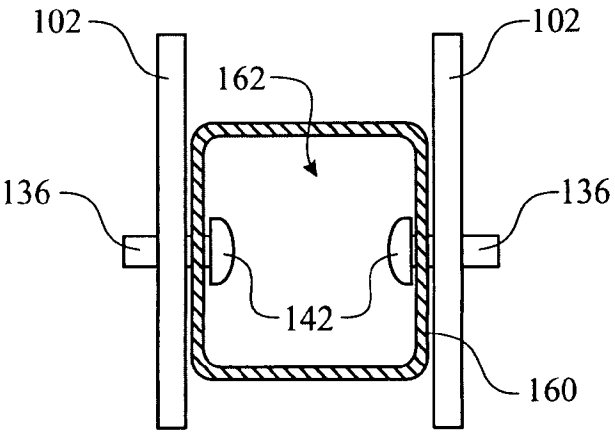
FIG. 13 is a sectioned top view of the exemplary embodiment of the release mechanism taken along section 13-13 of FIG. 11.
Figure 27:
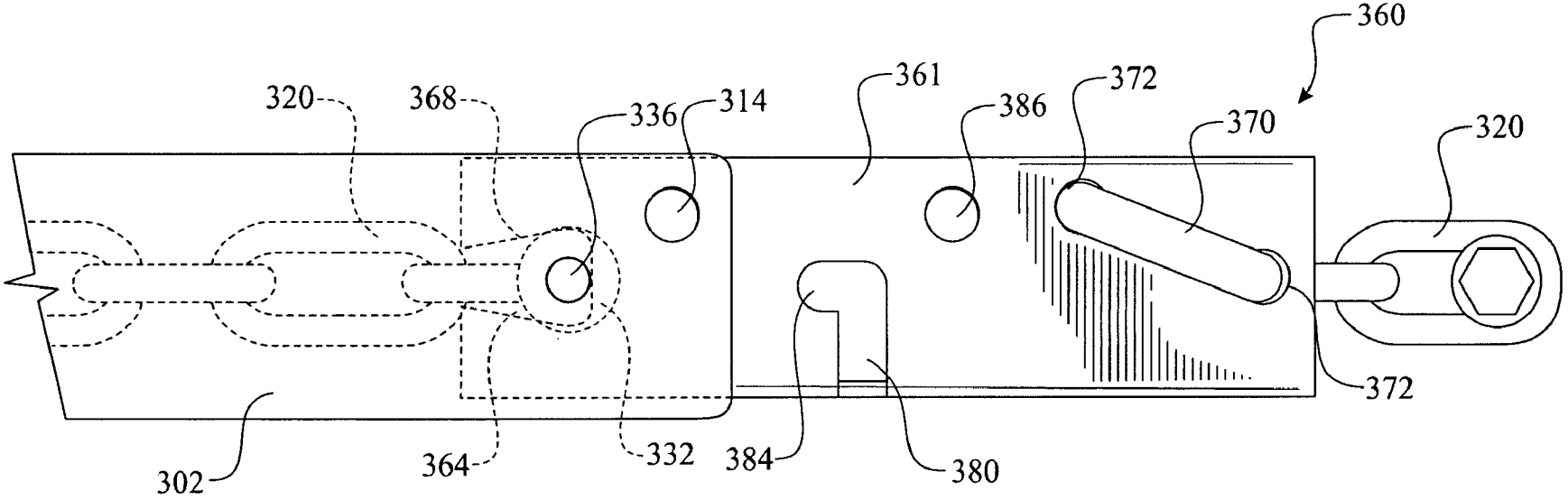
FIG. 27 is an elevation view of the release mechanism installed in a release ready configuration.

A releasing mechanism 360 is provided for securing a chain 320 in a desired relation to the releasing anchor 300. The releasing mechanism 360 is formed via a release member tubular body 361 having a release body central passage 362 and assembling the chain 320 therethrough. A first end of the chain 320 is fastened to the stock chain section 308 via an anchor shackle 322, with the opposing end of the chain 320 being fastened to an anchor line (not shown, but well understood) via a line shackle 324. While the releasing mechanism 360 is engaged with the shank 302, the releasing mechanism 360 maintains the chain 320 in relation with a distal end of the shank 302, such that the releasing anchor 300 engaged with the sea floor, until the releasing mechanism 360 pivots beyond a predetermined angle. Once the releasing mechanism 360 pivots beyond a predetermined angle provided by the form factor of the release interface notch 364, the releasing mechanism 360 disengages changing the direction of pull by the boater, thus releasing the anchor for the sea floor, as best illustrated in FIG. 9. The releasing mechanism 360 is fabricated from a release member tubular body 361 having a pair of release interface notch 364 created on opposite sides of the release member tubular body 361 at a releasing end. The release interface notch 364 initiates along a releasing edge of the release member tubular body 161, and continue longitudinally. The longitudinal walls or notch side walls 368 of the release interface notch 364 can be angled as illustrated, to aid in the re-installation of the release member tubular body 131 into a mooring configuration. In the exemplary embodiment, the two non-parallel notch side walls 368 of each release interface notch 364 are oriented diverging away from each other as the side walls extend away from the releasing end of said release mechanism 360. The release interface notches 364 engage with the shoulder bolt shaft 334 of the shoulder bolt 330. An elastic retaining member 370 is assembled to the release member tubular body 361 inserting the elastic-chain interface 374 section through a link of a chain 320. The elastic retaining member 370 can be secured to the release member tubular body 361 in any of a variety of means, with the exemplary embodiment inserting the elastic retaining member 370 through a pair of elastic member securing aperture 372 disposed through each of two opposing sides of the release member tubular body 361 as shown. The release member tubular body 361 is pulled away from the crown 310, applying a tension to the release member tubular body 361 maintaining each of the release interface notches 364 in communication with the respective shoulder bolt shaft 334, as shown in FIG. 27. When the releasing mechanism 360 is rotated to a release angle, the release interface notch 364 disengages from the shoulder bolt shaft 334. Where a triangular shaped release interface notch 164 (FIG. 9) is utilized, the release angle is less than 90 degrees. Where a dovetail shaped release interface notch 364 (FIG. 22) is utilized, the release angle is greater than 90 degrees. Where a square shaped release interface notch (not shown) is utilized, the release angle is generally 90 degrees. An optional chain clearance 366 can be provided at the releasing end of the release member tubular body 361, on the sides of the release member tubular body 361 that are perpendicular to the release interface notch 364. The chain clearance 366 provides clearance for the chain during rotation, reducing resistance during the pivoting of the release member tubular body 361 about the shoulder bolt shaft 334.

Figure 24:
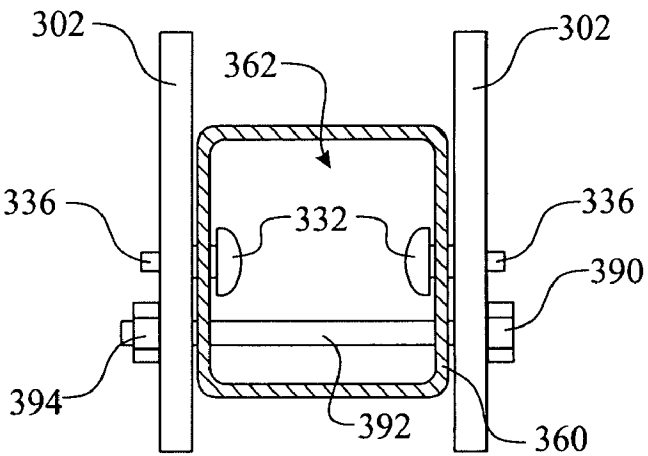
FIG. 24 is a sectioned top view of the exemplary embodiment of the release mechanism taken along section 24-24 of FIG. 23.
Figure 23:
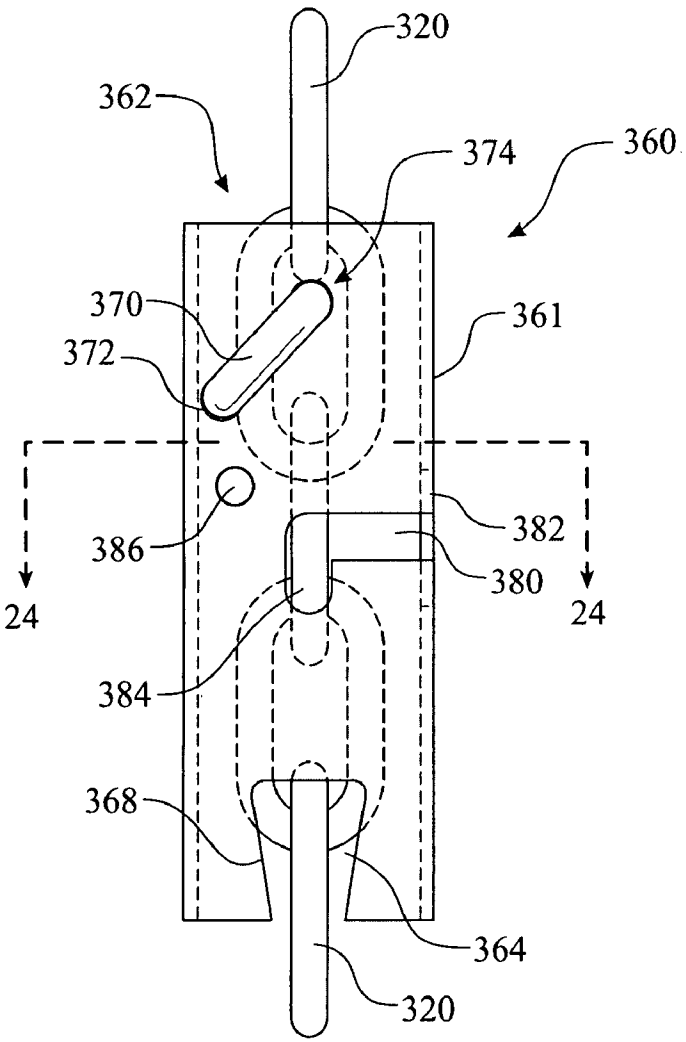
FIG. 23 is an elevation view of the releasing mechanism presented in FIG. 21.
Figure 28:
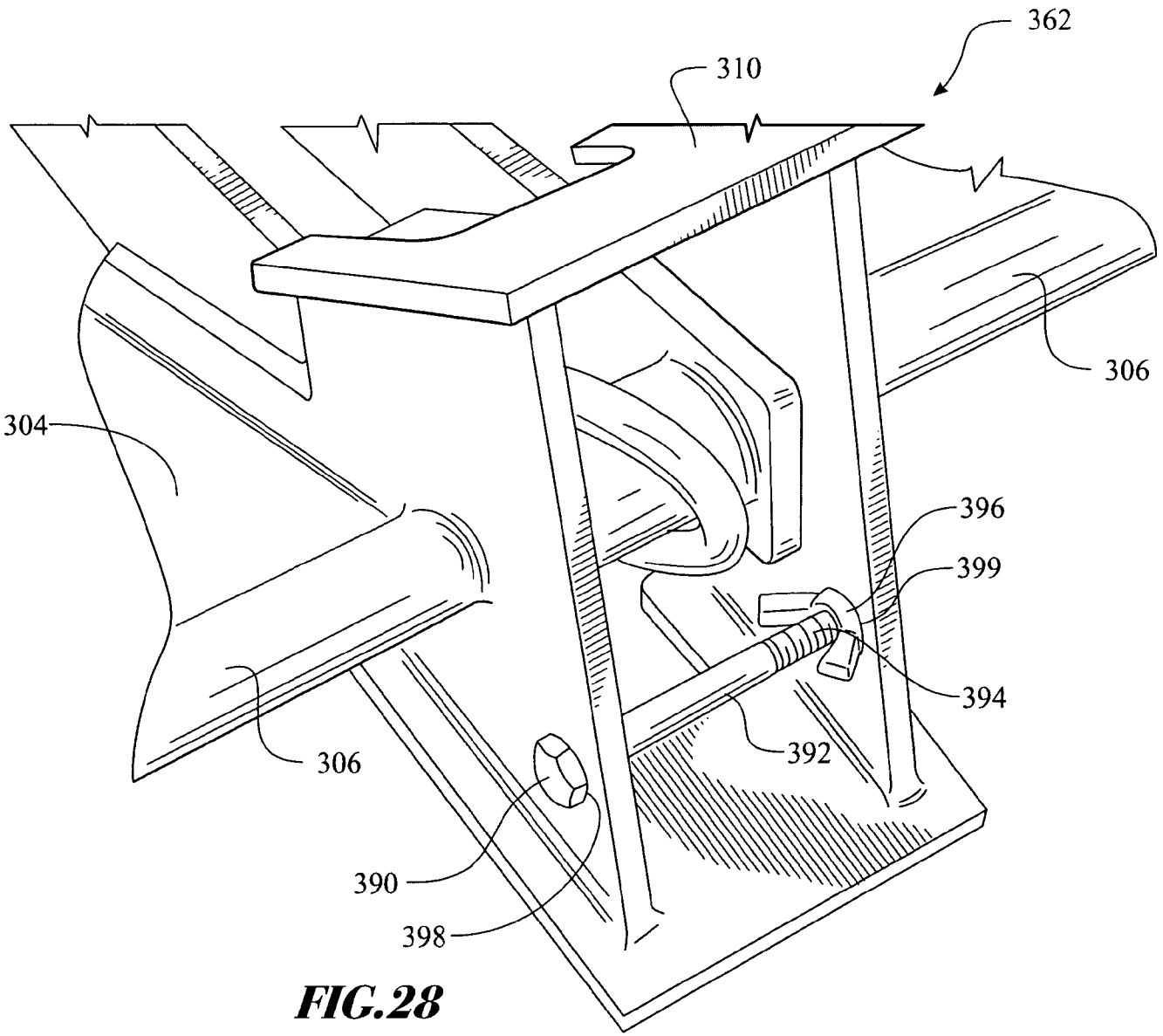
FIG. 28 is an isometric view of a portion of an anchor crown having a stored release override bolt disposed thereon.

A release mechanism override feature or a storm locking feature can be included; comprising a release override seat 384 formed along the same axial centerline as the release interface notch 364. It is recognized the release interface slot 364 can be utilized as the release override seat 384. A release override access slot 382 is cut through the release member tubular body 361 providing a passage clearance for the shoulder bolt head 332. A release override slot 380 is formed therethrough, providing a pathway for the shoulder bolt shaft 334 to travel and become seated in the release override seat 384. A release override bolt aperture 386 is drilled through the sidewalls of the release member tubular body 361, wherein the release override bolt aperture 386 aligns with a release override bolt aperture 314 (FIG. 27) provided through each of the shanks 302. The release member tubular body 361 is assembled to the releasing anchor 300 in a storm or storage configuration by inserting the shoulder bolt shaft 334 through the release override slot 380 and seating the shoulder bolt shaft 334 in the release override seat 384. The shoulder bolt head 332 maintains the shank 302 from inadvertently separating from the releasing mechanism 360. When seated properly, the release override bolt aperture 386 aligns with the release override bolt aperture 314, allowing the user to affix a release override bolt 390 therethrough (FIG. 24). The release override bolt 390 is preferably stored in the crown 310 as illustrated in FIG. 28. A release override bolt shaft 392 is inserted through a release override bolt mounting aperture 398. A wing nut 396 is then threaded onto a release override bolt threaded section 394 of the release override bolt head 390. The release override bolt 390 continues through, having the release override bolt threaded section 394 threaded into a release override bolt threaded aperture 399 provided in the opposing wall of the crown 310. The wing nut 396 is then unscrewed locking the release override bolt 390 in position.

Figure 16:
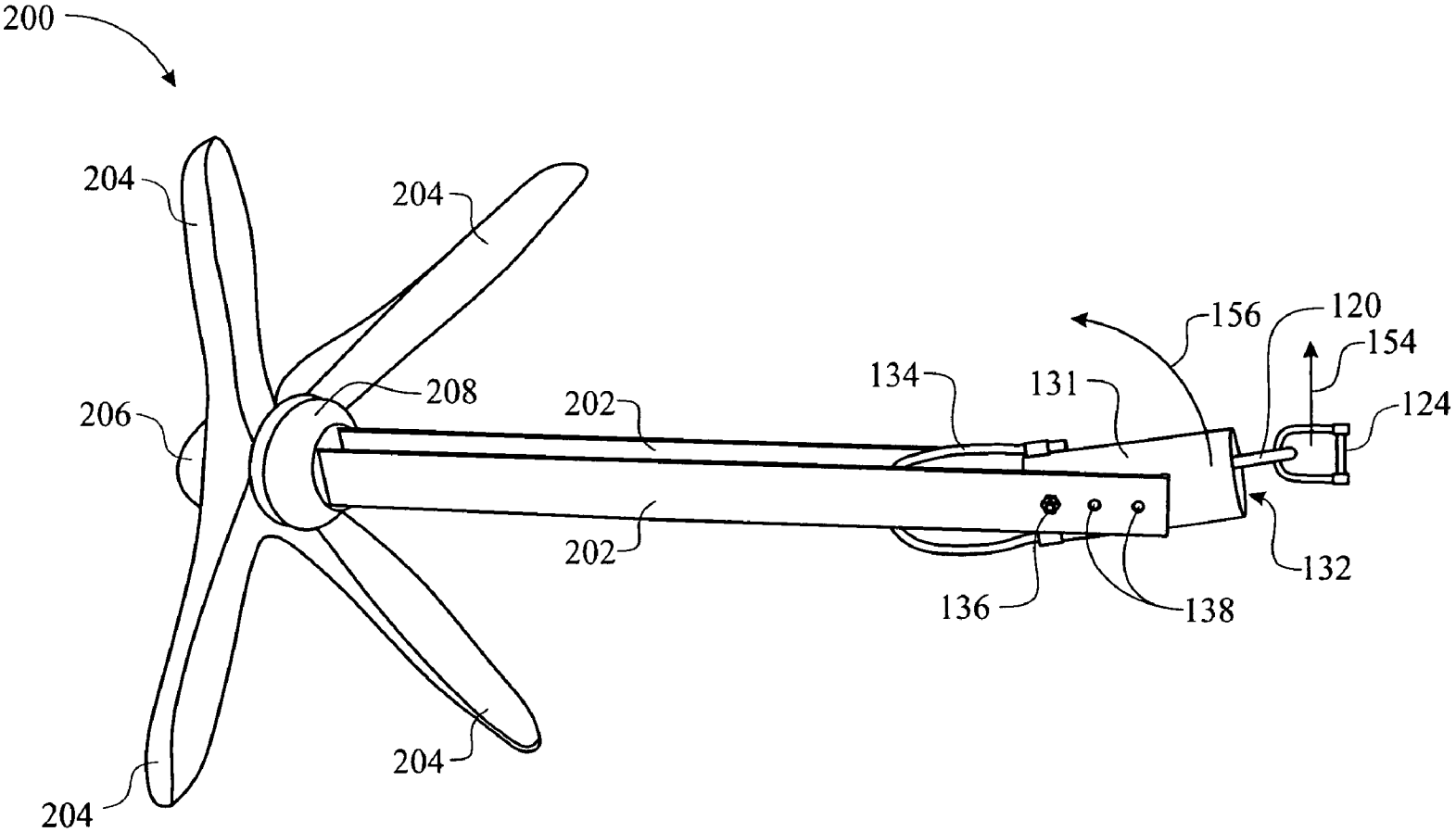
FIG. 16 is an isometric view of an alternate exemplary anchor configuration incorporating a grappling anchor head arrangement.
Figure 18:
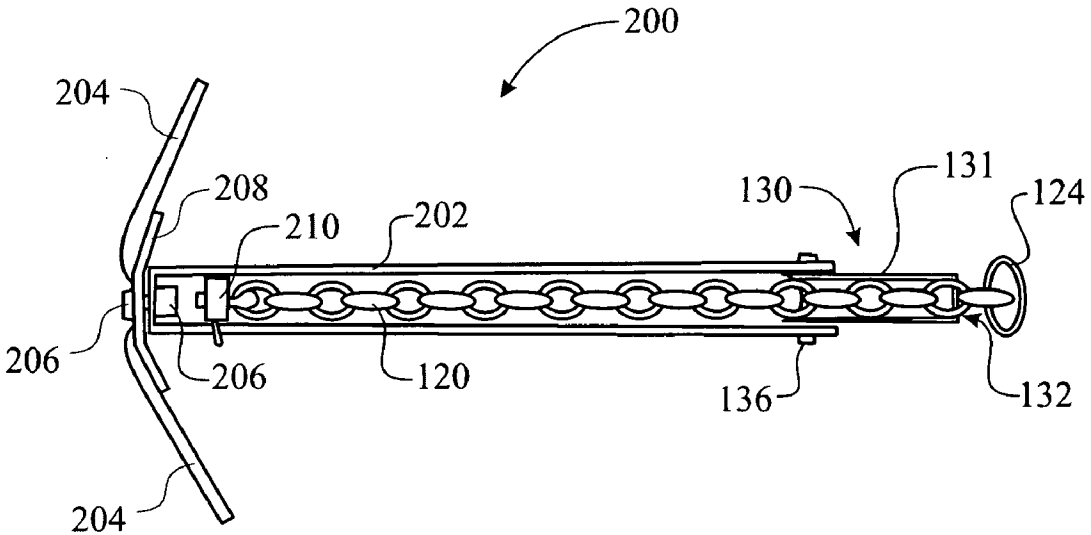
FIG. 18 is a top view of the grappling anchor configuration.
Figure 17:
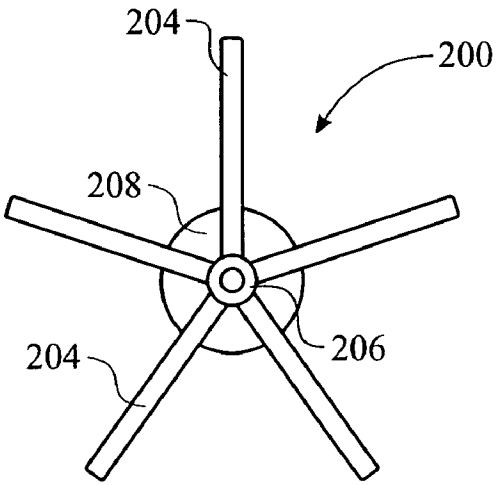
FIG. 17 is an end view of a grappling anchor configuration.

Expanding the teachings herein, the rotational and pivotal shank 202 to head 204 interface illustrated in FIG. 16 can be incorporated into any anchor form factor. The degree of rotation and pivotal motion can be as limited or as broad as desired (or limited) by the specific form factor as well as the designer's choice.

While the preferred embodiments of the invention have been described above, it will be recognized and understood that various modifications can be made in the invention and the appended claims are intended to cover all such modifications which may fall within the spirit and scope of the invention.

We claim:

1. A disengaging anchor, the anchor comprising an anchoring head, a shank being an elongated member projecting from the anchor head;

a pair of release fasteners disposed proximate a distal end of the shank;

an anchor chain attached to a portion of the anchor located proximate a crown section of the anchor head;

a tubular release mechanism, wherein the anchor chain is slidably inserted through a hollow center portion of the tubular release mechanism;

a release notch located on each of opposing sides initiating at a proximal end of the tubular release mechanism and continuing longitudinally; and a tension controlling mechanism elastically coupled between the tubular release mechanism and at least one of the anchor chain and the shank.

2. A disengaging anchor as recited in claim 1, wherein the tension controlling mechanism is assembled through a tension link in the anchor chain.

3. A disengaging anchor as recited in claim 1, wherein the tension controlling mechanism is assembled through a tension link in the anchor chain, the tension link being a link located within the tubular release mechanism.

4. A disengaging anchor as recited in claim 1, wherein the release notch is formed having two non-parallel side walls extending along a longitudinal axis of the release mechanism.

5. A disengaging anchor as recited in claim 4, wherein the two non-parallel side walls of the release notch are oriented diverting from each other as the side walls extend away from a releasing end of said release mechanism.

6. A disengaging anchor as recited in claim 4, wherein the two non-parallel side walls of the release notch are oriented converge towards each other as the side walls extend away from a releasing end of said release mechanism.

7. A disengaging anchor as recited in claim 1, wherein the anchor head is selected from a group comprising:

a) a fluke form factor, b) a grappling hook form factor, and c) a plough form factor.

8. A disengaging anchor, the anchor comprising an anchoring head, a shank being an elongated member projecting from the anchor head;

a pair of release fasteners disposed proximate a distal end of the shank;

an anchor chain attached to a portion of the anchor located proximate a crown section of the anchor head;

a tubular release mechanism, wherein the anchor chain is slidably inserted through a hollow center portion of the tubular release mechanism;

a release notch located on each of opposing sides initiating at a proximal end of the tubular release mechanism and continuing longitudinally;

a tension controlling mechanism elastically coupled between the tubular release mechanism and at least one of the anchor chain and the shank; and a release mechanism override feature comprising a release override notch formed within said tubular release mechanism to engage with said release override fastener and a release override fastener which couples said tubular release mechanism and shank together.

9. A disengaging anchor as recited in claim 8, wherein the tension controlling mechanism is assembled through a tension link in the anchor chain.

10. A disengaging anchor as recited in claim 8, wherein the release notch is formed having two non-parallel side walls extending along a longitudinal axis of the release mechanism, and wherein the two non-parallel side walls of the release notch are oriented diverting from each other as the side walls extend away from a releasing end of said release mechanism.

11. A disengaging anchor as recited in claim 8, wherein the release notch is formed having two non-parallel side walls extending along a longitudinal axis of the release mechanism, and wherein the two non-parallel side walls of the release notch are oriented converge towards each other as the side walls extend away from a releasing end of said release mechanism.

12. A disengaging anchor as recited in claim 8, wherein the release override notch further comprising a release override seat for receiving said release fastener, said release override seat being in axial alignment with a center of said release interface notch.

13. A disengaging anchor as recited in claim 8, wherein said release override fastener is stowed in said crown section of said anchor.

14. A disengaging anchor, the anchor comprising an anchoring head, a shank being an elongated member projecting from the anchor head;

a pair of release fasteners, each release fastener comprising a shaft;

the shaft having a first end affixed to the shank at a location being distal from said anchor head, and a second end having a dimension that is greater than a diameter of the shaft;

an anchor chain attached to a portion of the anchor located proximate a crown section of the anchor head;

a tubular release mechanism, wherein the anchor chain is slidably inserted through a hollow center portion of the tubular release mechanism;

a release notch located on each of opposing sides initiating at a proximal end of the tubular release mechanism and continuing longitudinally; and a tension controlling mechanism elastically coupled between the tubular release mechanism and at least one of the anchor chain and the shank.

15. A disengaging anchor as recited in claim 14, wherein the tension controlling mechanism is assembled through a tension link in the anchor chain.

16. A disengaging anchor as recited in claim 14, wherein the tension controlling mechanism is assembled through a tension link in the anchor chain, the tension link being a link located within the tubular release mechanism.

17. A disengaging anchor as recited in claim 14, wherein the release notch is formed having two non-parallel side walls extending along a longitudinal axis of the release mechanism, and wherein the two non-parallel side walls of the release notch are oriented diverting from each other as the side walls extend away from a releasing end of said release mechanism.

18. A disengaging anchor as recited in claim 14, wherein the release notch is formed having two non-parallel side walls extending along a longitudinal axis of the release mechanism, and wherein the two non-parallel side walls of the release notch are oriented converge towards each other as the side walls extend away from a releasing end of said release mechanism.

19. A disengaging anchor as recited in claim 14, said release mechanism further comprising a release mechanism override feature comprising a release override notch formed within said tubular release mechanism to engage with said release override fastener and a release override fastener which couples said tubular release mechanism and shank together.

20. A disengaging anchor as recited in claim 19, wherein the release override notch further comprising a release override seat for receiving said release fastener, said release override seat being in axial alignment with a center of said release interface notch.

* * * * *